United States Patent [19]

Gunderson

[11] Patent Number: 4,938,513

[45] Date of Patent: Jul. 3, 1990

[54] FLEXIBLE LATCH

[75] Inventor: Jeffrey E. Gunderson, Cottage Grove, Wis.

[73] Assignee: Acry Fab, Inc., Madison, Wis.

[21] Appl. No.: 427,047

[22] Filed: Oct. 25, 1989

[51] Int. Cl.[5] ..... E05C 19/06

[52] U.S. Cl. ..... 292/80; 292/87; 292/DIG. 38

[58] Field of Search ..... 292/DIG. 38, 87, 80, 292/19, 91, 17, 20, 76, DIG. 16, DIG. 61

[56] References Cited

U.S. PATENT DOCUMENTS

| | | | |
|---|---|---|---|
| 86,601 | 2/1869 | Still | 292/87 |
| 269,806 | 12/1882 | McArthur | 292/17 |
| 1,035,666 | 8/1912 | Walpuski et al. | 292/80 |
| 1,076,933 | 10/1913 | Zindel | 292/91 |
| 3,083,046 | 3/1963 | Eberly | 292/87 X |
| 4,462,142 | 7/1984 | Hickling | 403/329 |

FOREIGN PATENT DOCUMENTS

| | | | |
|---|---|---|---|
| 815464 | 10/1951 | Fed. Rep. of Germany | 292/87 |
| 54014 | 11/1946 | France | 292/87 |
| 0785454 | 12/1980 | U.S.S.R. | 292/87 |

*Primary Examiner*—Lloyd A. Gall
*Attorney, Agent, or Firm*—Lathrop & Clark

[57] ABSTRACT

A latch for a transparent display box is disclosed having a flexible plastic band with a planar attachment segment adapted for attachment to the inside front surface of the lid. An upper arcuate segment extends upwardly from the attachment segment, and a planar flex segment depends from the upper arcuate segment and is substantially parallel to and longer than the attachment segment. A lower arcuate segment depends from the flex segment beneath the upper arcuate segment and an engaging segment extends upwardly from the lower arcuate segment parallel to the flex segment and in substantial alignment with the attachment segment. A projecting nub on the engaging segment is adapted to engage in a hole in the base when the lid is closed on the base. The flexing of the arcuate segments and the flex and engaging segments enables the nub to move inward from the inside surface of the front of the box when the lid is closed to allow the nub to engage in the hole. The latch may be fabricated entirely of transparent plastic.

5 Claims, 3 Drawing Sheets

FLEXIBLE LATCH

FIELD OF THE INVENTION

This invention relates to latches and in particular to flexible latches for boxes.

BACKGROUND OF THE INVENTION

When an article is to be displayed in a protected yet clearly visible fashion it may be placed in a transparent display box. Objects so displayed, be they merchandise, sales samples, works of art, artifacts of historical importance, or other display items, may be approached and inspected at close range while at the same time being protected from dust, air currents, atmospheric conditions, and unwanted handling. Although display boxes may be fabricated of clear glass, transparent plastic, such as acrylic or polycarbonate plastic, is preferred because of its workability and crack resistance. Plastic may be drilled, cut and shaped much more easily than glass and plastic parts may be attached to other plastic parts by means of adhesives or solvent bonding. Plastic display boxes may be constructed entirely of transparent plastic material without any opaque hardware required. What is needed is a latch for such a transparent box that does not introduce a significant visual obstruction into the box. The flexible band latch disclosed in co-pending patent application Ser. No. 07/245,017 is transparent, but requires that a door be closed against a jamb. What is also needed is a latch which can close the cover and base of a box leaving a flush exposed surface.

SUMMARY OF THE INVENTION

The latch for a box with a hinged lid and a base with a hole according to this invention has a flexible band formed of elastic plastic material with a planar attachment segment adapted for attachment to the inside front surface of the lid. An upper arcuate segment extends upwardly from the attachment segment. A planar flex segment depends from the upper arcuate segment and is substantially parallel to and longer than the attachment segment. A lower arcuate segment depends from the flex segment beneath the first arcuate segment. An engaging segment extends upwardly from the lower arcuate segment and is parallel to the flex segment and in substantial alignment with the attachment segment. A projecting nub on the engaging segment is adapted to engage in the hole of the base. The arcuate segments and the flex and engaging segments are adapted to deflect when the lid is closing on the base to enable the nub to engage in the hole. The flexible plastic material may be transparent.

It is an object of the present invention to provide a latch for a box which is substantially transparent.

It is also an object of the present invention to provide a plastic unitary latch to ioin the lid to the base of a hinged box with a substantially flush front surface.

It is a further object of the present invention to provide a latch for a box that closes with more ease than it opens. These objects and others will become apparent from the following detailed description taken in conjunction with the accompanying drawings wherein a preferred embodiment of the invention has been selected for exemplification.

DESCRIPTION OF THE PREFERRED EMBODIMENTS

Figure 1:
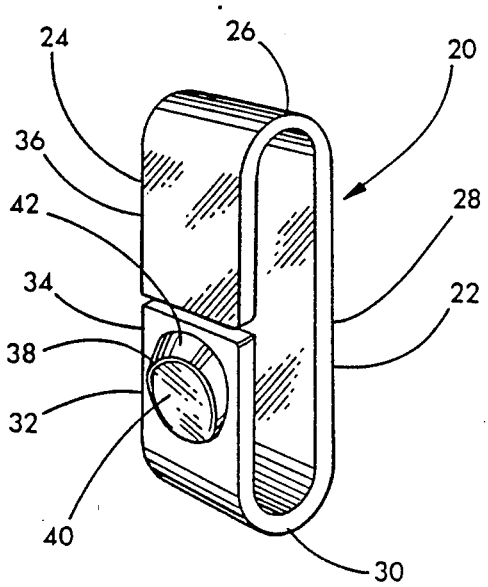
FIG. 1 is a perspective view of the latch of this invention.

Referring now to FIGS. 1–7, wherein like numerals refer to similar parts, the preferred latch 20 includes a flexible plastic band 22 which is roughly in the shape of the letter "C" and has a generally rectangular and uniform cross-sectional shape. The band 22 has an attachment segment 24 which is generally planar, an upper arcuate segment 26 which extends upwardly from the attachment segment 24, a planar flex segment 28 which is longer than the attachment segment 24 and which depends from the upper arcuate segment 26 in substantially parallel relationship to the attachment segment 24, a lower arcuate segment 30 which depends from the flex segment 28, and a planar engaging segment 32 which extends upwardly from the lower arcuate segment 30 in substantially parallel relationship to the flex segment 28 and in general alignment with the attachment segment 24. The engaging segment 32 terminates in close proximity to the attachment segment 24. The front surface 34 of the engaging segment 32 is in substantially the same plane as the front surface 36 of the attachment segment 24. A cam-surfaced nub 38 is affixed to the center of the front surface 34 of the engaging segment 32. The nub 38 may be approximately half the height of the engaging segment 32 and may have a circular cross section at its base. The nub 38 has a closing ramp 40, and an opening ramp 42. The pitch and run of the two ramps may vary depending on the latching strength and ease of opening or closing desired. The opening ramp 42 preferably has a steeper pitch and shorter run than the closing ramp 40. The nub 38 may be affixed to the engaging segment 32 by an adhesive or by a process such as solvent welding, or it may be molded as an integral part of the flexible band 22. The latch 20 may be constructed entirely of polycarbonate plastic material or any other transparent, suitably elastic, plastic material.

Figure 2:
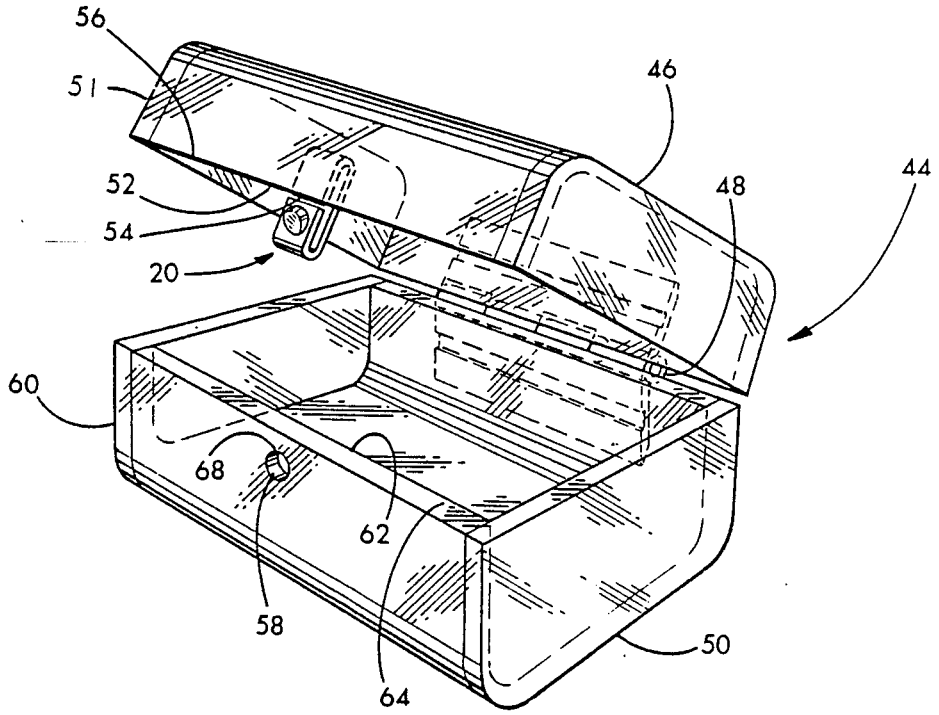
FIG. 2 is a perspective view of the latch of FIG. 1 affixed to an opened display box.
Figure 3:
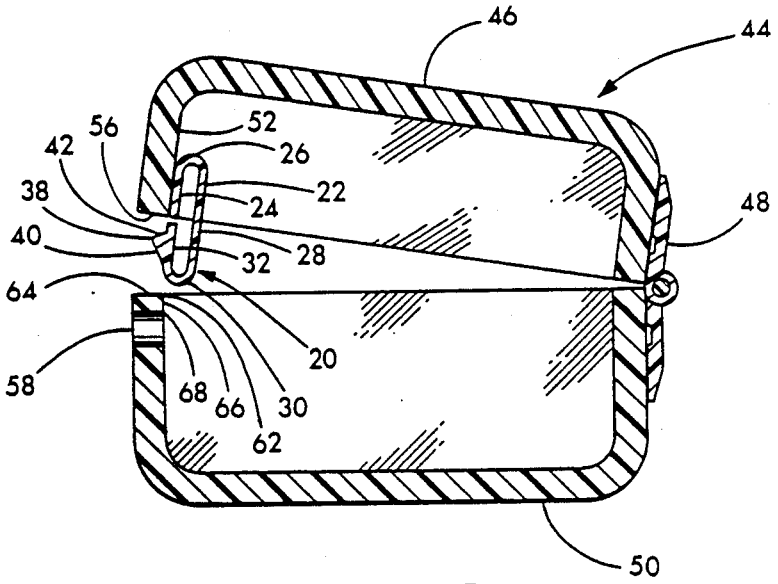
FIG. 3 is a cross sectional view of the display box and latch of FIG. 2 in an opened position.
Figure 4:
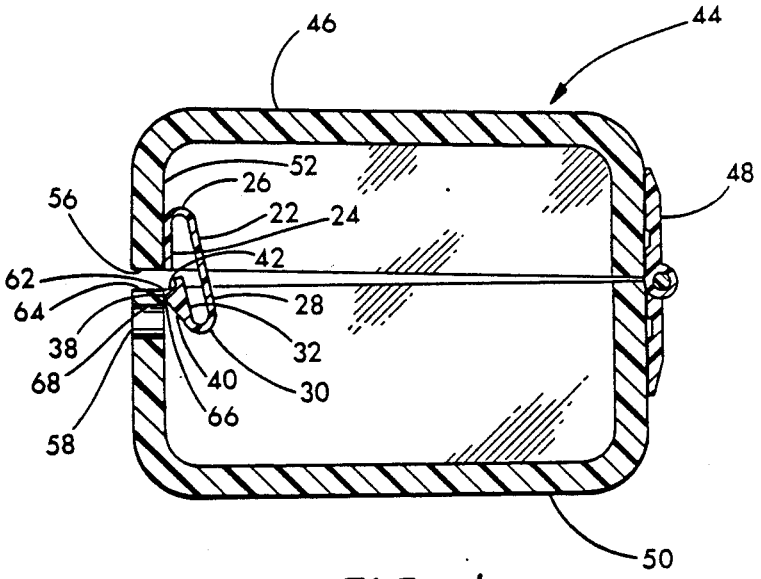
FIG. 4 is a cross sectional view of the display box and latch of FIG. 2 in a partially closed position.

FIG. 2 shows the latch 20 affixed to a transparent plastic box 44. The box has a lid 46 rotatably joined by a hinge 48 to a base 50. When the box is closed the front portion 51 of the lid 46 abuts the front 60 of the base 50 to form a flush exposed front of the box. The latch 20 is affixed by an adhesive or a bonding process to the inner front surface 52 of the lid 46. The attachment section 24 of the latch 20 is affixed to the lid 46 so that the bottom edge 54 of the attachment section 24 aligns with the lid rim 56. The latch 20 is positioned so that, when closed, the nub 38 will be in position to engage the nub hole 58 which is drilled in the front 60 of the base 50. It is not necessary for the nub hole 58 to completely pierce the front 60 of the base 50 so long as it is deep enough to accept the nub 38.

As shown in FIGS. 3–6 the latch 20 of this invention may be used to releasably fix the lid 46 of a box 44 to its base 50. The latch 20 is in its undeformed configuration in FIG. 3 when the lid of the box is open. In this configuration the engaging segment 32 is aligned with the attachment segment 24 and substantially parallel to the flex segment 28. When the box is open the nub 38 of the latch 20 is not in contact with the base 50.

Figure 5:
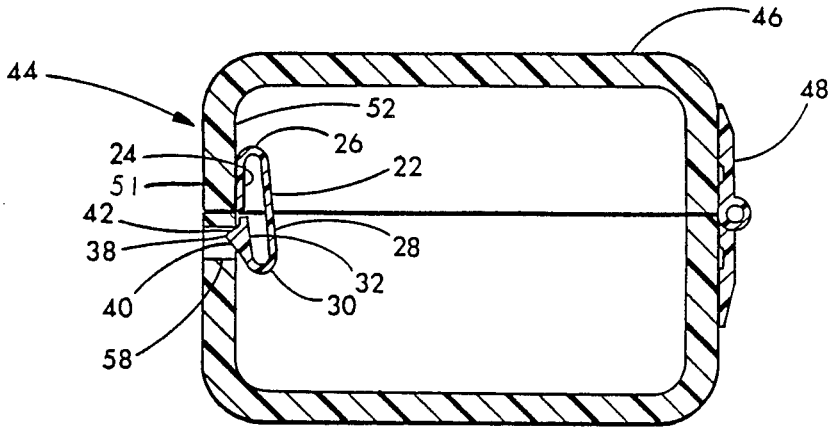
FIG. 5 is a cross sectional view of the display box and latch of FIG. 2 in a closed position.

To close the box 44 the lid 46 is pressed down over the base 50. This pressure brings the closing ramp 40 of the nub 38 into contact with the interior edge 62 of the base rim 64. When contact is made and downward force is continually exerted on the latch 20, the nub 38 is driven down over the interior edge 62 causing the closing ramp 40 to ride inward on the interior edge 62 and thereby flexing the engaging segment 32 and the flex segment 28 as well as the two arcuate segments 26, 30 of the latch 20 until the nub 38 clears the interior edge 62 and rides up on the inner front surface 66 of the base 50. Under continued downward force the nub 38 of the latch 20 rides along the inner front surface 66 until it reaches the nub hole 58, at which point the spring energy of the deflected attachment segment 24 and the flex segment 28 of the latch 20 drive the nub 38 into the nub hole 58. The box is then closed as shown in FIG. 5.

The resilient force of the flexible band 22 acts to keep the nub 38 engaged in the nub hole 58. Any minimal forces, such as jostling of the box, air currents, or vibrations will be resisted by the resilient force of the band 22. This resilient force is generally sufficient to retain the box in a closed configuration even under the force of gravity should the box be lifted by only the lid or overturned.

Figure 6:
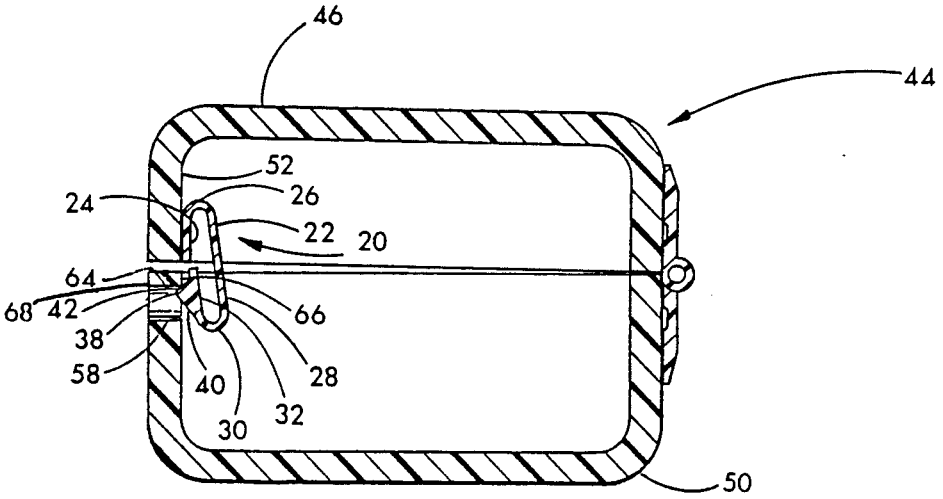
FIG. 6 is a cross sectional view of the display box and latch of FIG. 2 in a partially opened position.

The opening ramp 42 of the nub 38 is more steeply pitched and of shorter run than the closing ramp 40. Thus a greater force applied over a shorter distance is required to open the box than to close it. To open the box 44, the lid 46 is pulled away from the base 50 as shown in FIG. 6. This action causes the opening ramp 42 of the nub 38 to make contact with the upper edge 68 of the nub hole 58. A continued applied force causes the nub 8 to ride inward over the upper edge 68 and onto the inner front surface 66 of the base 50. The nub 38 will then run along the inner front surface 66 until the base rim 64 is cleared. At that point, the lid 46 will be unlatched from the base 50 and the deflected segments of the latch 20 will return to their original configuration as in FIG. 3. In practice, opening and closing of the box 44 equipped with the latch 20 takes place in a very short time and requires a firm but not excessive amount of hand pressure.

A latch constructed according to the present invention effectively extends the length of the "lever arm" which is deflected by engagement of the base 50 and the nub 38. The flex segment 28 deflects from an area high up on the inner surface 52 of the lid 46, and extends to well below the point of application of force against the nub 38. Furthermore, the only portion of the latch 22 that is rigidly fixed to the box during opening and closing is the attachment segment 24 which is fixed to the inner front surface of the cover. The arcuate segments 26, 30 of the band 22 will also deflect when the nub 38 is deflected. Thus, the entire band 22 from the point of application of force at the nub 38 to the fixed attachment segment 24 will act as one continuous spring. This extended, deflectable, combined lever arm made up of the engaging segment 32, the lower arcuate portion 30, the flex segment 28 and the upper arcuate portion 26 not only insures that the opening and closing of the box will not cause plastic deformation, but also makes it easier to latch and unlatch the box 44.

The latch 20 may be constructed to any dimensions within the material limitations of the plastic used, but a latch 20 with a flex segment 28 one inch in length is effective for most small boxes.

Figure 7:
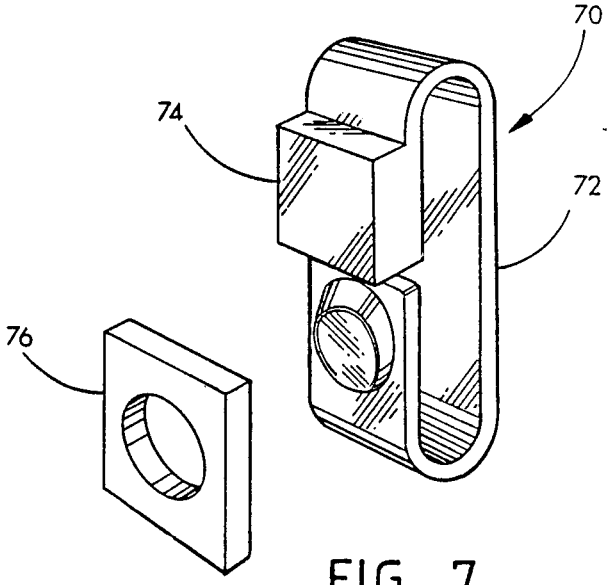
FIG. 7 is an exploded perspective view of a modified form of the latch of this invention having a separate nub hole fixture.

FIG. 7 shows a latch 70 of this invention adapted to be mounted on a box without the need for piercing the base of the box to produce a nub hole. The latch 70 has a flexible band 72 with a double thickness attachment segment 74 and a nub hole chip 76 which may be glued at an appropriate location beneath the latch 70 on the base of a box. The latch 70 is affixed to the inner front surface of the box lid and operates in the same manner as the latch 20.

The flexible band of the latch of this invention may be made of varying thicknesses to increase or decrease the latching strength of the latch. Likewise the angles and depth of the opening and closing ramps may be varied. The shape of the flexible band may also be varied so long as it retains the essential features of this invention. For example the flex segment may be a sector of a circle or an ellipse and still function as required. The shape of the nub and the nub hole may be other than a circle. A box may be fitted with more than one latch. The latch and nub hole may also be located on the side of a box instead of on the front. The attachment segment may also be mounted on the base of the box with the nub hole located in the lid.

It should be understood that this invention is not limited to the particular construction and arrangement of parts herein illustrated and described, but embodies all such modified forms thereof as come within the scope of the following claims.

I claim:

1. A reclosable display box comprising:

(a) a base having a rim and portions defining a nub hole;

(b) a lid hingedly attached to the base and having an inside front surface;

(c) a latch having a flexible plastic band with a planar attachment segment attached to the inside front surface of the lid, an upper arcuate segment extending upwardly from the attachment segment, a planar flex segment depending from the first arcuate segment and substantially parallel to the attachment segment, a lower arcuate segment depending from the flex segment, and an engagement segment extending upwardly from the lower arcuate segment parallel to the flex segment and in substantial alignment with the attachment segment; and (d) a projecting nub on the engagement segment adapted to engage in the hole in the base when the lid is closed on the base, the flex segment and the engaging segment being adapted to deflect when the lid is closed on the base to enable the nub to engage in the hole.

2. A latch for a box with a hinged lid having an inside front surface and a base with a hole, comprising:

(a) a flexible plastic band having a planar attachment segment adapted for attachment to the inside front surface of the lid, an upper arcuate segment extending upwardly from the attachment segment, a planar flex segment depending from the upper arcuate segment and substantially parallel to and longer than the attachment segment, a lower arcuate segment depending from the flex segment beneath the upper arcuate segment, and an engaging segment extending upwardly from the lower arcuate segment parallel to the flex segment and in substantial alignment with the attachment segment; and (b) a projecting nub on the engaging segment adapted to engage in the hole in the base when the lid is closed on the base, the flex segment, the arcuate segments and the engaging segment being adapted to deflect when the lid is closing on the base to enable the nub to engage in the hole.

3. The latch of claim 1 wherein the nub has an inclined opening ramp on the side facing the attachment segment, and an inclined closing ramp on the side away from the attachment segment, the incline of the opening ramp being greater than the incline of the closing ramp.

4. The latch of claim 1 wherein the band and nub are formed out of transparent plastic material.

5. A latch for a box with a hinged lid having an inside front surface and base, comprising:

(a) a flexible plastic band having a planar attachment segment adapted for attachment to the inside front surface of the lid, an upper arcuate segment extending upwardly from the attachment segment, a planar flex segment depending from the upper arcuate segment and substantially parallel to and longer than the attachment segment, a lower arcuate segment depending from the flex segment beneath the upper arcuate segment, and an engaging segment extending upwardly from the lower arcuate segment parallel to the flex segment;

(b) a planar chip having portions defining a nub hole and adapted for mounting on the base of the box, wherein the thickness of the chip and the engaging segment together are substantially equal to the thickness of the attachment segment; and (c) a projecting nub attached to the engaging segment and adapted to engage within the nub hole when the lid is closed on the base, the flex segment and the engaging segment being adapted to deflect when the lid is closed on the base to enable the nub to engage in the hole.

* * * * *

UNITED STATES PATENT AND TRADEMARK OFFICE

CERTIFICATE OF CORRECTION

PATENT NO. : 4,938,513

DATED : July 3, 1990

INVENTOR(S) : Gunderson

It is certified that error appears in the above-identified patent and that said Letters Patent is hereby corrected as shown below:

Column 3, line 44, "nub 8" should be -- nub 38 --.

Column 5, line 13, "claim 1" should be -- claim 2 --.

Column 5, line 18, "claim 1" should be -- claim 2 --.

Signed and Sealed this

Fifth Day of May, 1992

*Attest:*

DOUGLAS B. COMER

*Attesting Officer*

*Acting Commissioner of Patents and Trademarks*